US009587895B1

(12) United States Patent
Abbott

(10) Patent No.: US 9,587,895 B1
(45) Date of Patent: Mar. 7, 2017

(54) ROTATABLE FIREARM BOLT

(71) Applicant: Brian F. Abbott, Fort Worth, TX (US)

(72) Inventor: Brian F. Abbott, Fort Worth, TX (US)

( * ) Notice: Subject to any disclaimer, the term of this patent is extended or adjusted under 35 U.S.C. 154(b) by 0 days.

(21) Appl. No.: 15/000,272

(22) Filed: Jan. 19, 2016

(51) Int. Cl.
*F41A 3/26* (2006.01)
*F41F 1/10* (2006.01)

(52) U.S. Cl.
CPC . *F41A 3/26* (2013.01); *F41F 1/10* (2013.01)

(58) Field of Classification Search
CPC ..... F41A 3/26; F41F 1/10
USPC ..... 89/12
See application file for complete search history.

(56) References Cited

U.S. PATENT DOCUMENTS 340,772 A * 4/1886 Cermak et al. ..... F28F 13/12 165/109.1
3,595,128 A * 7/1971 Hoyt, Jr. ..... F41F 1/10 42/16
3,611,866 A * 10/1971 Jacolucci ..... F41F 1/10 42/16
3,996,684 A * 12/1976 Bauman ..... F41A 3/26 42/16
4,563,937 A * 1/1986 White ..... F41A 3/26 42/7
6,742,434 B1 * 6/2004 Dillon ..... F41A 3/26 42/16
7,568,422 B1 * 8/2009 Barrett ..... F41A 3/26 89/180
7,703,374 B1 * 4/2010 Dillon ..... F41A 7/10 89/12
7,930,964 B1 * 4/2011 Dillon ..... F41A 13/06 89/12
2002/0020097 A1 * 2/2002 Murello ..... F41A 3/26 42/16
2012/0180354 A1 * 7/2012 Sullivan ..... F41A 3/26 42/16

* cited by examiner

*Primary Examiner* — Troy Chambers
*Assistant Examiner* — Bridget Cochran
(74) *Attorney, Agent, or Firm* — Dobbin IP Law P.C.; Geoffrey E. Dobbin

(57) ABSTRACT

A bolt for a firearm having a rotatable head and carrier body has a twisted polygonal keyed interface between the head and carrier body. A neck extending rearward from the head presents the keyed interface with a corresponding bore within the carrier body. This construction reduces torque moments between the head and carrier body as compared to prior art bolts. Camming loads on the neck may be constructed with inverses to create space for tolerance and lubricant.

5 Claims, 11 Drawing Sheets

ROTATABLE FIREARM BOLT

FIELD OF THE INVENTION

The present invention relates to the field of firearms and more particularly relates to a bolt for a multiple barreled rotary firearm.

BACKGROUND OF THE INVENTION

The modern "mini-gun," or M-134, can trace its origins to the original Gatling gun of the mid-nineteenth century. It is a machine gun which fires projectiles in an automatic fashion. In the process of firing these projectiles, the gun utilizes a plurality of barrels (usually six) which consecutively rotate in a circular circuit into a single position which allows for the firing of a projectile. Each barrel, then, is only used to fire one-sixth of the projectiles, spending the remaining time cooling in an air current caused by the rotation of the barrels. Over time, many improvements have been made to the original Gatling gun, resulting in the modern M-134. However, each variant of the M-134 has always featured the rotatable barrels which are the signature characteristic of this family of firearms.

Most modern firearms utilize cartridge ammunition. As cartridge is a fairly simple structure, with a projectile, or bullet, nested over an explosive charge of propellant. The charge and projectile are held together by a casing, or head. This casing presents a rearward primer which, when crushed, ignites and this ignition travels to the charge, igniting it explosively and thereby providing the impetus for launching the projectile. In most modern firearms, particularly with rifles, the primer is impacted by a firing pin. This firing pin is a spring-loaded hammer residing within a firearm bolt and, when released, impacts the primer of properly seated ammunition. The firearm bolt is also used to seat the next successive round of ammunition and, frequently, aids in the ejection of spent cartridges. Usually in an M-134 or Gatling variant each barrel will have its own bolt. The bolt usually has a body and a head which is movable with respect to the body.

The most commonly used M-134 bolt design in recent times is described in U.S. Pat. No. 3,611,866, issued in 1971 and assigned to the General Electric Company (the "GE Bolt"). A recent improvement is described in U.S. Pat. No. 6,742,434 to Dillon, (the "Dillon Bolt," FIGS. 4 and 5). The standard operation of an M-134 with the GE Bolt is described at length in the '866 patent, which is herein incorporated by reference. The operation is virtually identical with the Dillon Bolt. To summarize, and using the Dillon Bolt as an illustration, the release mechanism is built into the firearm bolt 1 itself. The bolt follows a track on the inside casing of the receiver (FIG. 3), traveling a helical path such that the forwardmost position is the firing position. The bolt acquires an ammunition cartridge in its travel and, as it moves forward, chambers the cartridge. At this point, the bolt head 7 is against a barrel but the helical track continues forward. Following the continuing track forces the bolt carrier 2 and head 7 to compress against each other. A helical cam arm 5 cantileverally extending from the bolt head 7 interfaces with a helical cam slot 4 in the bolt carrier 2, causing the head 7 to twist in relation to the bolt carrier 2, while simultaneously the compression cocks the firing pin 3. When fully twisted, about ⅙ turn, the firing pin 3 releases and impinges the cartridge primer. The firing pin is spring-biased forward with a compression spring and a blocking pin located aft of the spring. It is also linked to the head of the bolt by a separate release pin interfacing with an L-shaped slot with transverse and longitudinal legs. In its default position, the release pin resides in the transverse leg of the slot. Thus, as the bolt head and carrier collapse against each other, the firing pin is biased against the spring as it is forced against the spring by its interaction with the transverse slot. When the bolt head and carrier reach their point of maximum rotational difference, the release pin is translated to the corner of the L-shaped slot. This translation frees the release pin, and thus the firing pin, for motion along the longitudinal leg. This releases the stored spring tension, allowing the firing pin to impinge a cartridge primer with enough force to cause an ignition of the propellant contained within the cartridge. As the firearm bolt cycles away from the forwardmost position, the bolt head and carrier re-align, causing the engagement pin to relocate in the transverse leg of the L-slot, resetting for the next firing cycle.

One disadvantage of the GE Bolt involved the helical cam arm of the bolt head. As rotation was caused solely by the interaction of this single helical cam arm and a corresponding cam slot on the body, asymmetrical loads were placed on a singular and thin area of the bolt head. This caused a higher than desired rate of failure as these cam arms would occasionally break, rendering the bolt inoperative. This issue was addressed with the Dillon Bolt by adding a second helical cam arm 8 and cam slot 9 to the bolt structure to reduce the loads on a single cam arm 5; and, furthermore, the bolt could still function should one cam arm fail. However, while the Dillon Bolt is a marked improvement over the prior GE Bolt, it still places undue stress on two thin cantilevered appendages which, over time and with repeated loads, will eventually fail. What is needed is a firearm bolt which reduces or eliminates the loads placed on weaker areas of the structure while also being compatible with current M-134 designs.

The present invention represents a departure from the prior art in that the firearm bolt of the present invention allows for twisting of the bolt head in relation to the bolt body without utilizing a helical cam arm and slot system.

SUMMARY OF THE INVENTION

In view of the foregoing disadvantages inherent in the known types of bolt, this invention provides a firearm bolt with improved twisting motion of the bolt head. As such, the present invention's general purpose is to provide a new and improved firearm bolt that is backwards compatible with existing M-134 systems and yet even more sturdy and reliable than the prior art bolt systems.

The present invention is an improvement on both the GE and Dillon bolt structures in that the twisting motion of the bolt head is accomplished by utilizing a bolt neck, extending from the bolt head into the bolt body, which is keyed to a twisting bore in the bolt body, thereby imparting a twisting motion to the bolt head as it translates along the bolt body.

To accomplish these objectives, the firearm bolt comprises a bolt head with a hollow but twisted polygonal neck, serving as a key. The bolt carrier has a corresponding receiving bore while the firing pin is free to move through both the bolt head and bolt carrier. This keyed design reduces individual rotational moments on the head structure greatly by not only reducing the length of the torque arm of interfacing structures, but also further dividing the torque along the entire surface of the polygonal neck, virtually eliminating torque differentials along the twist imparting mechanism. Also, since the twist mechanism is in the interior of the firearm bolt, it is easily manufactured to be compatible with current M-134 designs, but also easily incorporated into future designs.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the firearm bolt is herein described. It should be noted that the articles "a", "an", and "the", as used in this specification, include plural referents unless the content clearly dictates otherwise.

Figure 1:
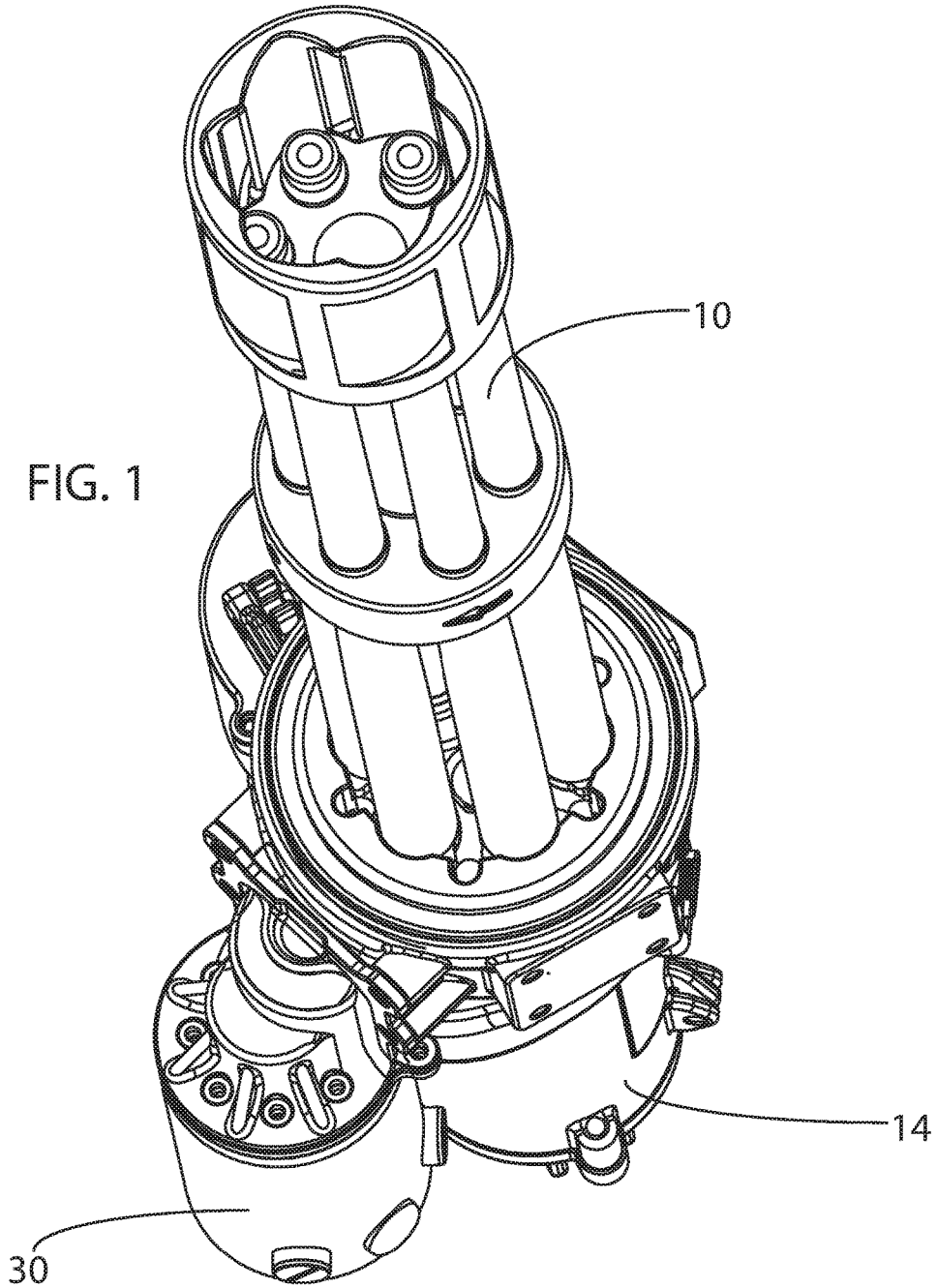
FIG. 1 is a front perspective view of a rotary firearm.
Figure 2:
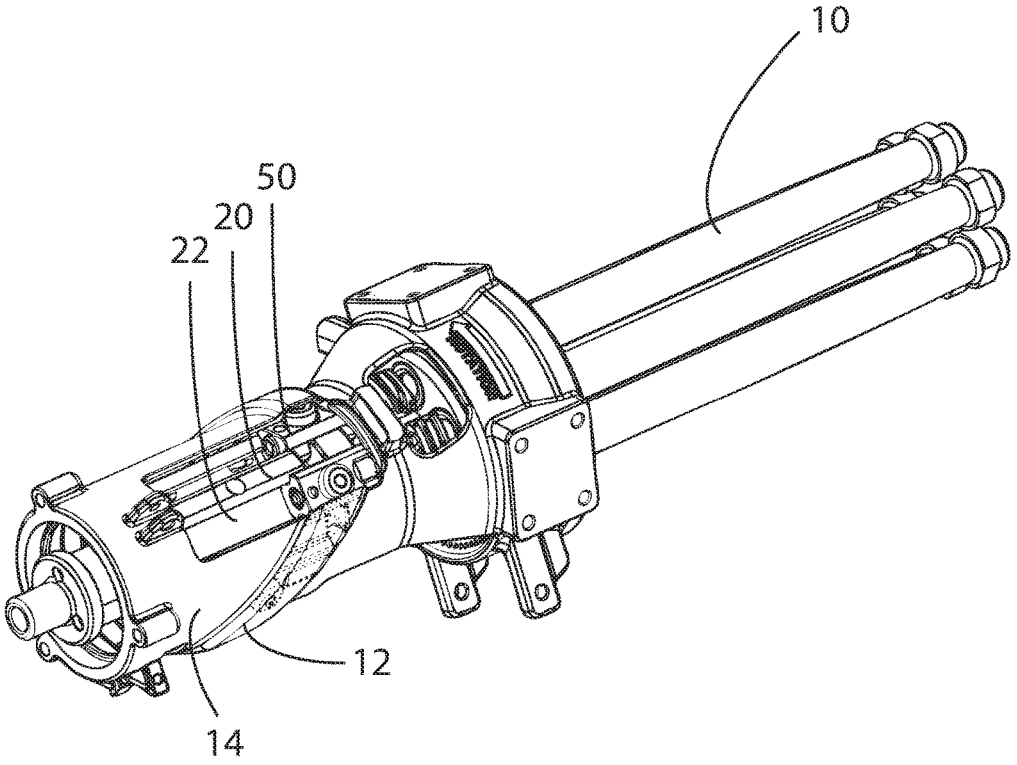
FIG. 2 is a partial sectional view of the rotary firearm of FIG. 1.
Figure 3:
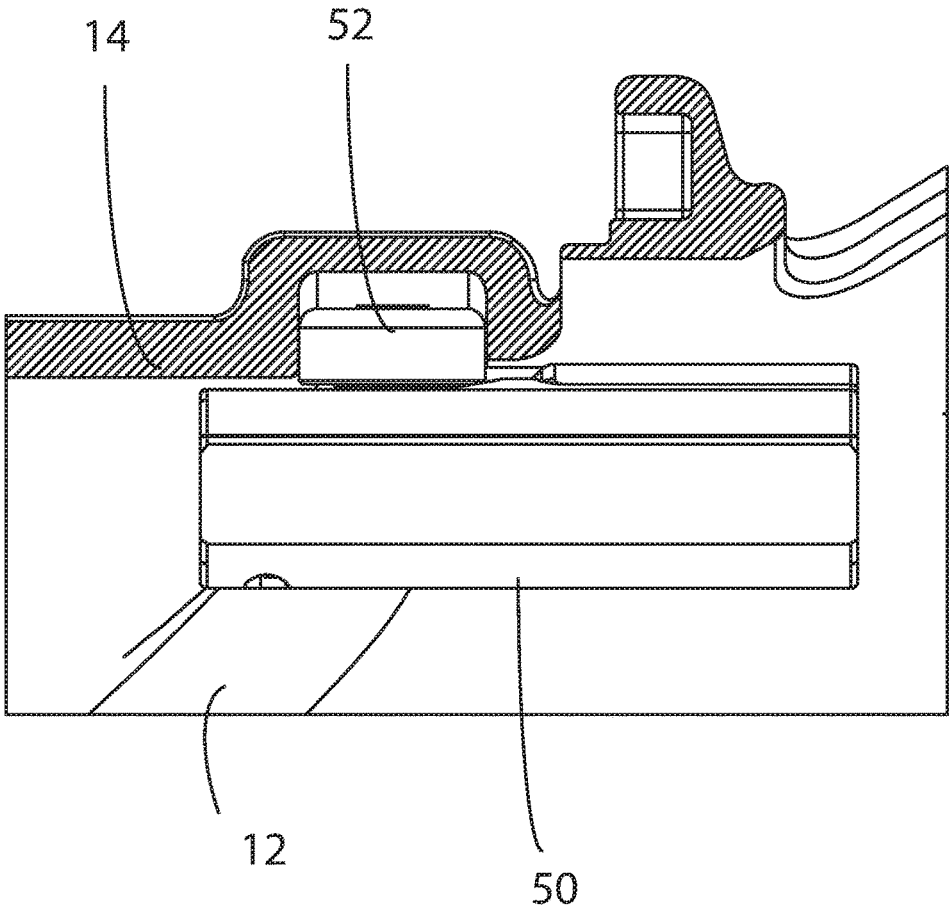
FIG. 3 is a sectional view of the rotary firearm of FIG. 2.

With reference to FIGS. 1 through 3, a representational M134 is depicted. As can be seen in FIGS. 1-3, this particular firearm embodiment features six barrels 10 mounted on a rotor 20 driven in turn by a motor 30. Belt-linked ammunition is fed into the weapon by first entering the delinker/feeding system, which strips individual rounds of ammunition from connecting links and advances individual rounds of ammunition onto one of six rotating slots 22 in the rotor, each corresponding to one barrel 10 and each having one bolt 50. Ammunition is advanced along a cam track 12 with the bolt 50 until it is chambered in a barrel 10 and ignited. After which the bolt 50 retracts, releasing the spent ammunition casing for ejection.

Advancement and retraction of the bolt 50 is accomplished by the interaction of a cam roller 52, positioned on the top surface of the bolt, and the helical cam track 12 fashioned in the receiver 14. As the rotor 20 rotates in a circuit, the cam roller 52 follows the cam track 12 and forces the bolt 50 forward or backwards according to where in the circuit the bolt and rotor are positioned. The forward most position for the bolt 50 is located when the bolt is at the top of the rotor 20 while the rearward most position has the bolt 50 at the bottom of the rotor 20.

Figure 4:
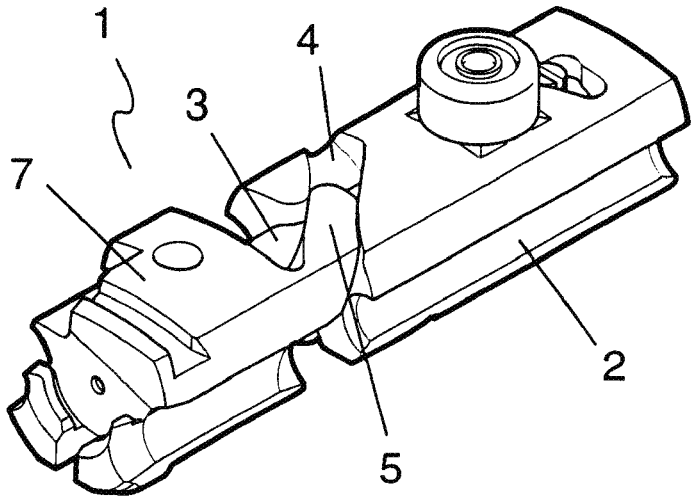
FIG. 4 Prior Art
FIG. 4 is a perspective view of a prior art firearm bolt.
Figure 5:
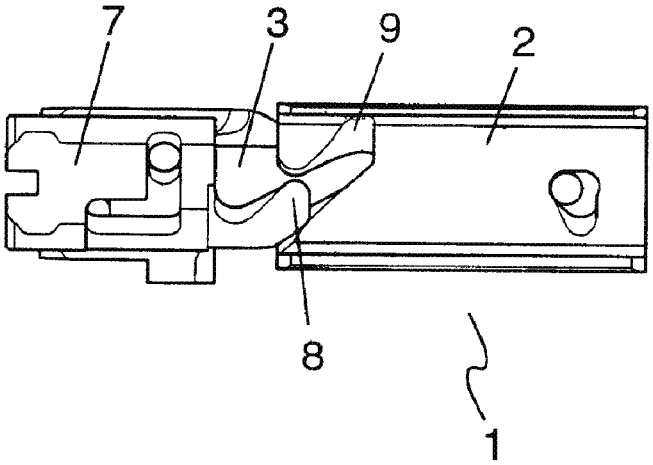
FIG. 5 Prior Art
FIG. 5 is a bottom plan view of the prior art bolt of FIG. 4.
Figure 6:
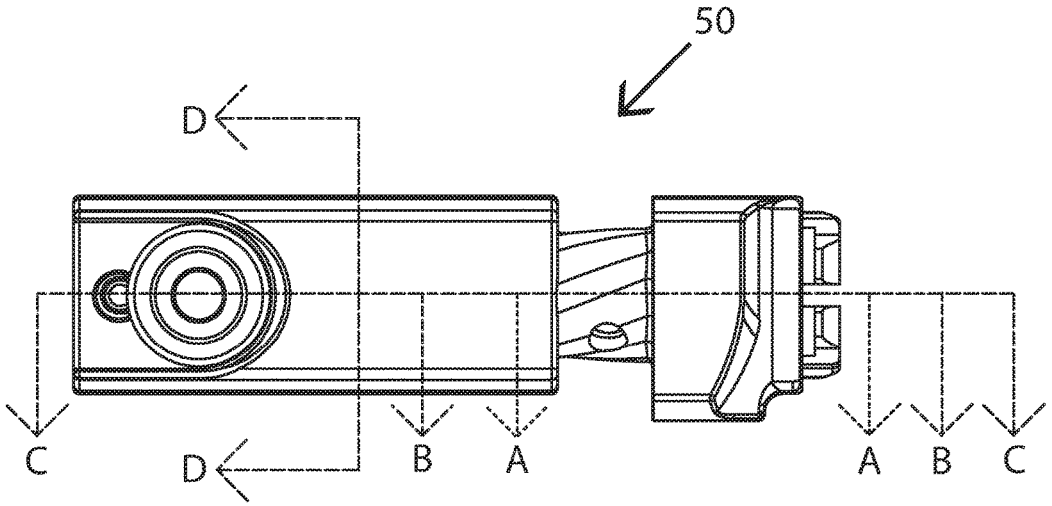
FIG. 6 is a top plan view of a firearm bolt representing a preferred embodiment of the invention.
Figure 7:
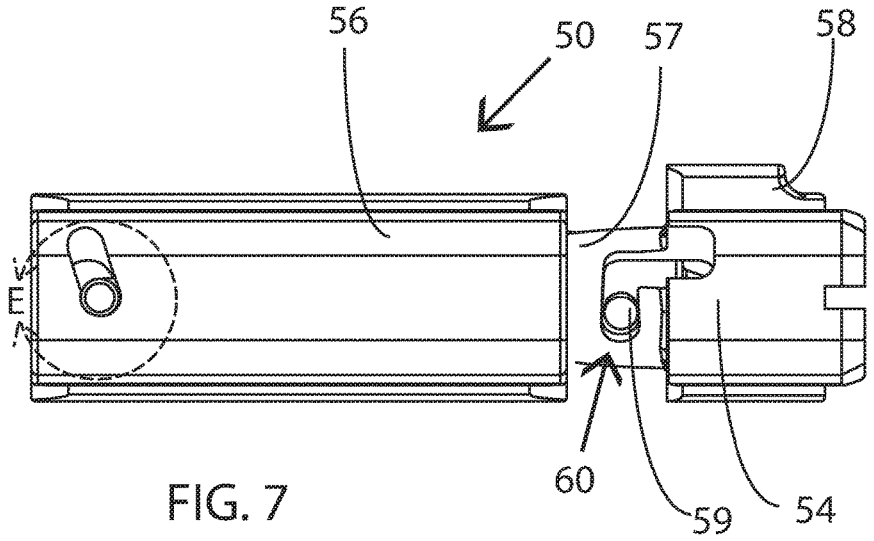
FIG. 7 is a bottom plan view of the firearm bolt of FIG. 6.
Figure 8:
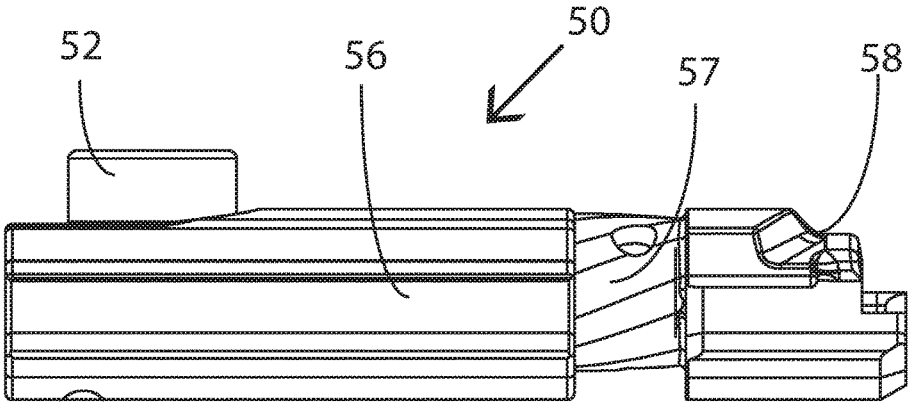
FIG. 8 is a side elevation of the firearm bolt of FIG. 6.
Figure 9:
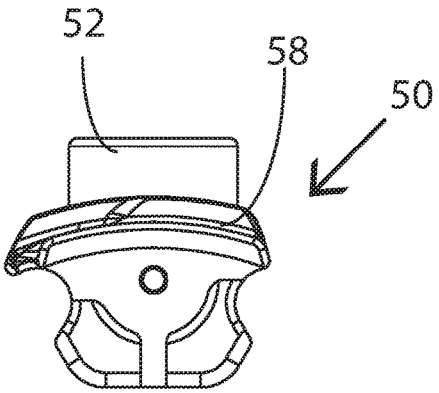
FIG. 9 is a front elevation of the firearm bolt of FIG. 6.
Figure 10:
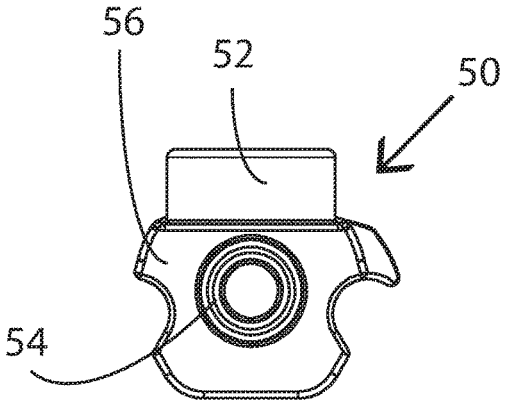
FIG. 10 is a rear elevation of the firearm bolt of FIG. 6.
Figure 11:
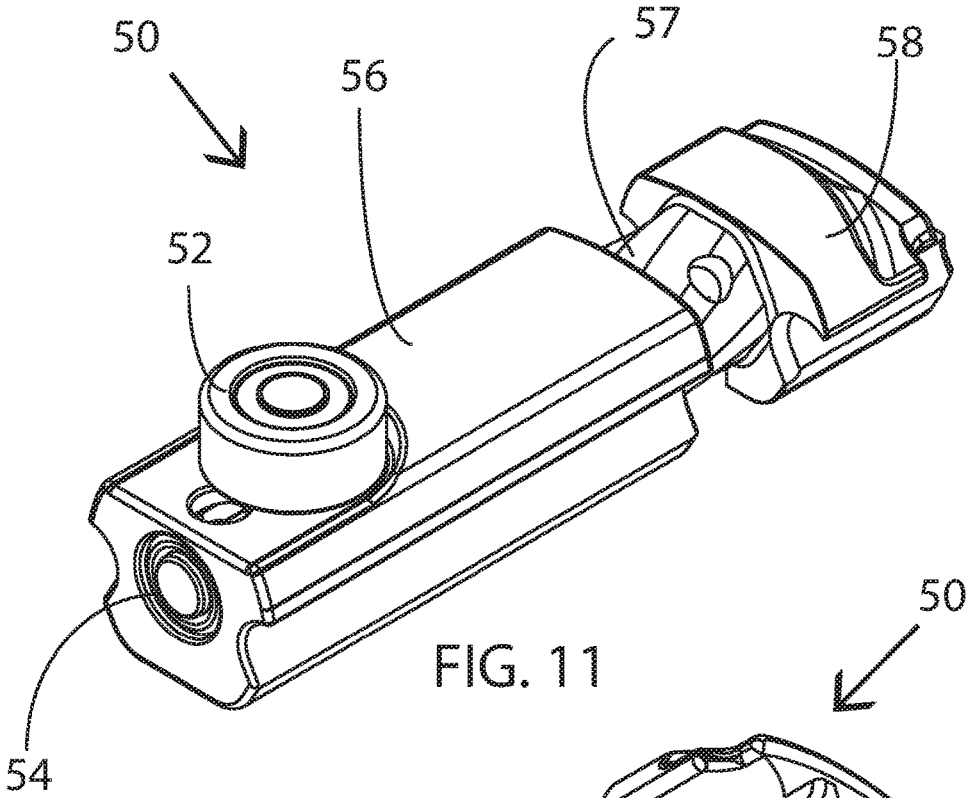
FIG. 11 is a perspective view of an alternate firearm bolt.

A prior art bolt, FIGS. 4 and 5, features a bolt head 7 and bolt carrier, or "body" 2. The bolt head 7 and body 2 interface with one or two rotation imparting cam structures, each comprising a helical cam arm 5 and a corresponding helical cam slot 4. As the bolt head 7 is compressed against the bolt body 2, the cam arm 5 interacts with the cam slot 4 and causes relative rotation to be imparted to the bolt head 2. As the bolt head 7 and body 2 separate, the same cam structure twists the bolt head 7 back into position relative the body 2.

Figure 17:
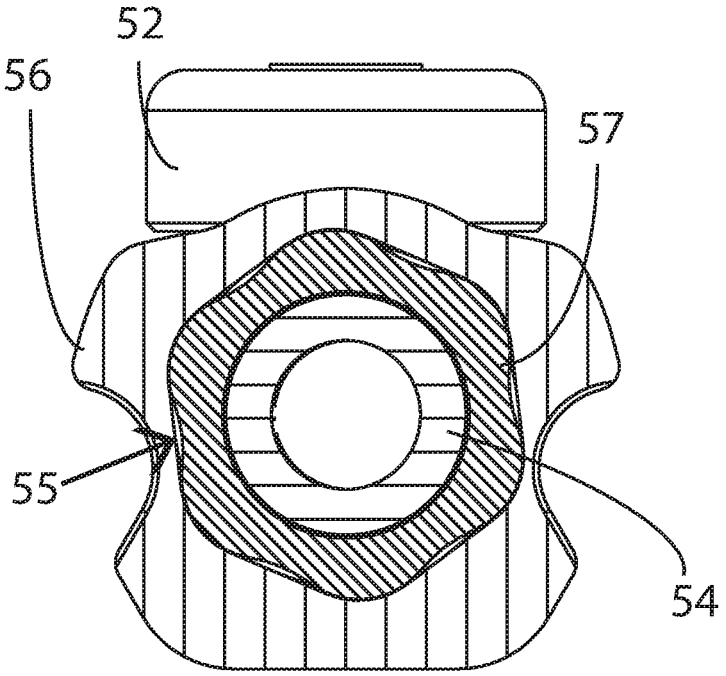
FIG. 17 is a sectional view of the firearm bolt of FIG. 6, taken along line D-D.

Like prior art bolts, a bolt 50 which may embody the present invention (FIGS. 6-13) may contain the firing pin 54 coaxial with a central axis of the bolt and also may comprise both a body 56 and a head 58, in a rotatable relationship with each other. The head 58 should have a single helical neck 57 insertable, coaxially, within the body 56. The firing pin 54 may be spring biased, such as by a coil spring 53 (FIG. 16) located between it and the rearward most portion of the bolt 50. Such a coil spring 53 could be maintained in position by a stop insert coaxial with the firing pin 54 and a reset pin 51. The firing pin 54 passes through both body 56 and neck 57, with the tip of the firing pin residing within the head 58. The present invention, however, eschews the use of helical cam arms and instead utilizes the neck 57 to impart a twist upon the head 58. This helical neck 57 corresponds with and is keyed to fit a helical bore 55 in the bolt body 56 (FIGS. 13-17). As the neck 57 is forced through the bore 55, the keyed relationship forces the necessary twist in the neck 57 and head 58. The depicted bolt 50 has a neck 57 with six individual camming loads as opposed to one or two, as is used in the prior art. It should be readily understood that other numbers of loads may be used, with fewer loads bearing more torque and more loads reducing the effect of the keying relationship. Six loads provides an adequate load distribution for purposes of the invention and also a good keyed relationship between the neck 57 and body 56. It is therefore preferred to have six loads, but this preference should not be seen as limiting. As can be seen in FIG. 17, the loads may be separated by slight indents or inverses. This structure would then give some mechanical tolerance and serve to leave space in the bolt bore 55 for lubricant.

Figure 12:
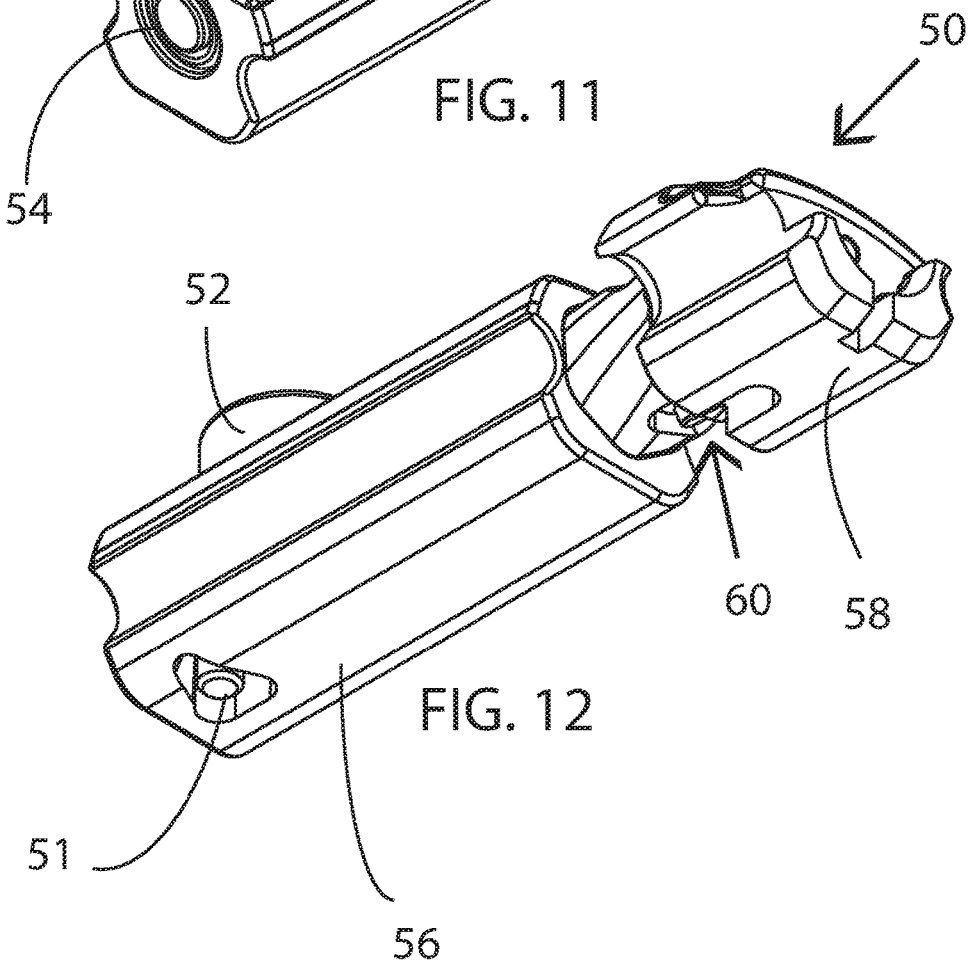
FIG. 12 is an alternate perspective view of the firearm bolt of FIG. 11.
Figure 13:
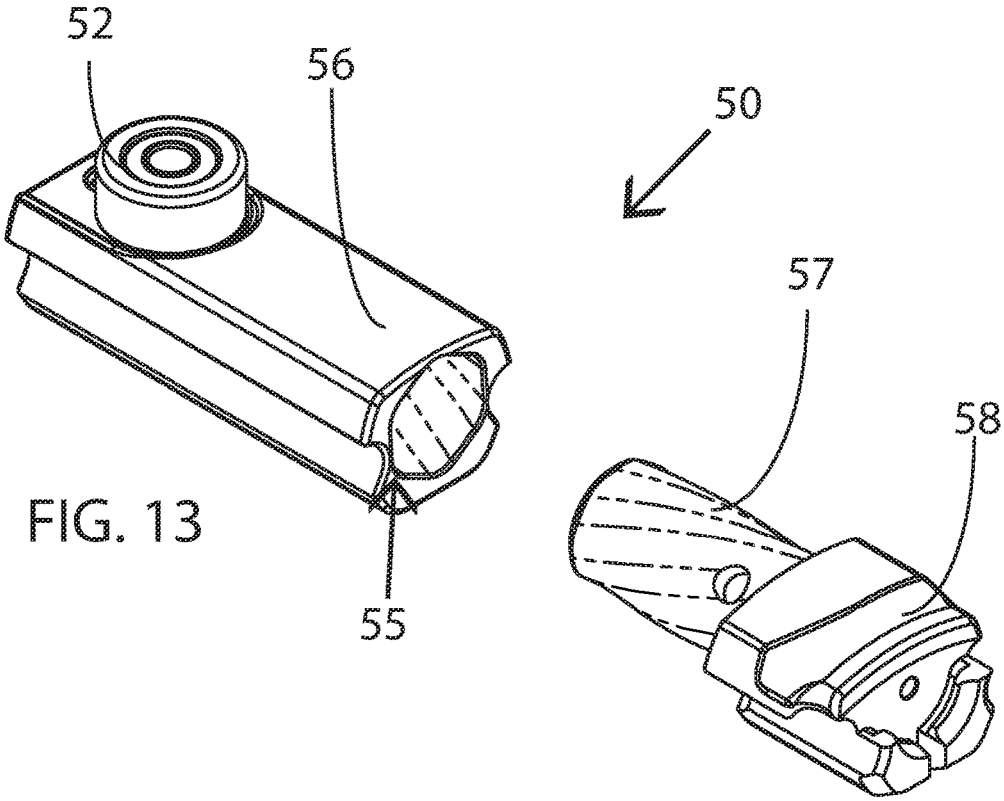
FIG. 13 is a perspective view of the fire arm bolt head and body of the bolt of FIG. 6, disassembled.
Figure 14:
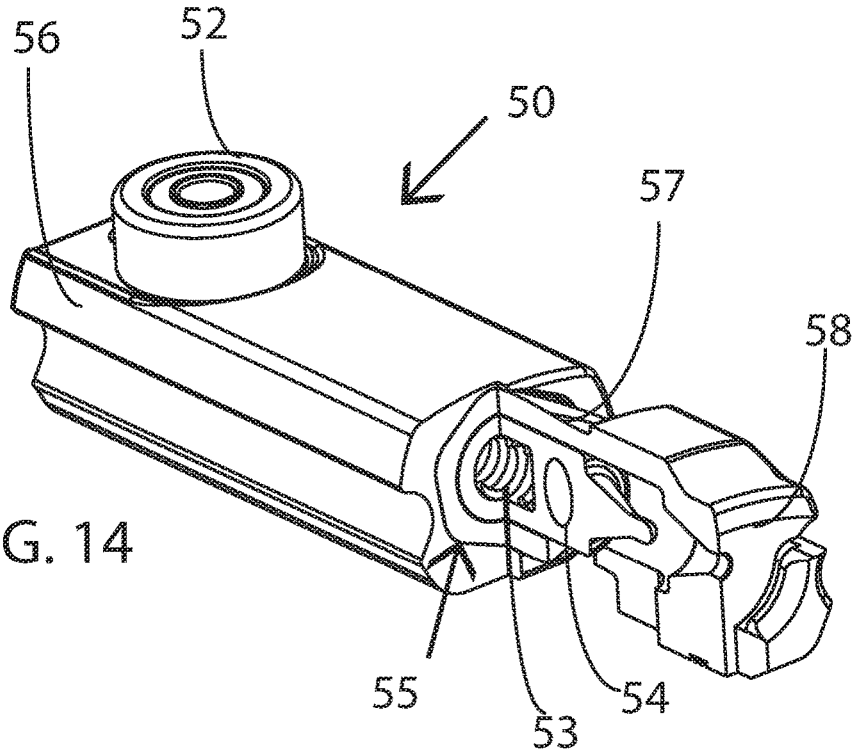
FIG. 14 is a sectional view of the firearm bolt of FIG. 6, taken along line A-A.
Figure 15:
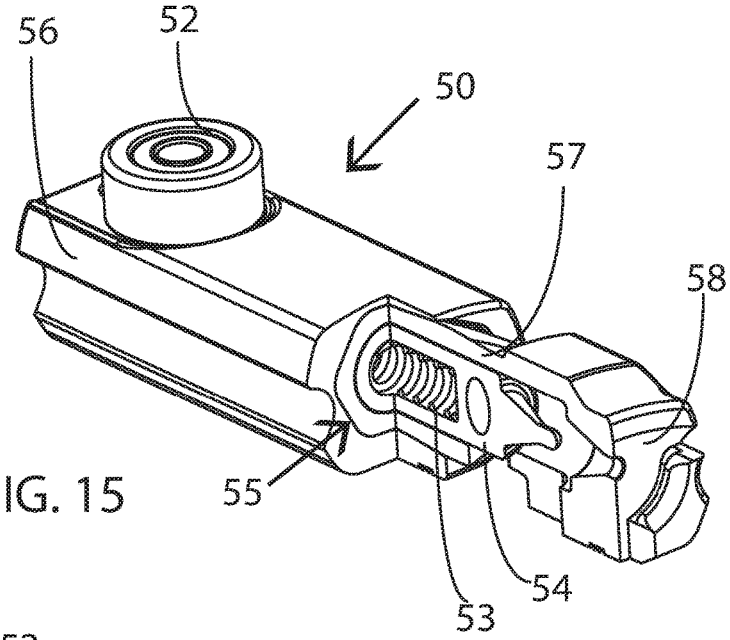
FIG. 15 is a sectional view of the firearm bolt of FIG. 6, taken along line B-B.
Figure 16:
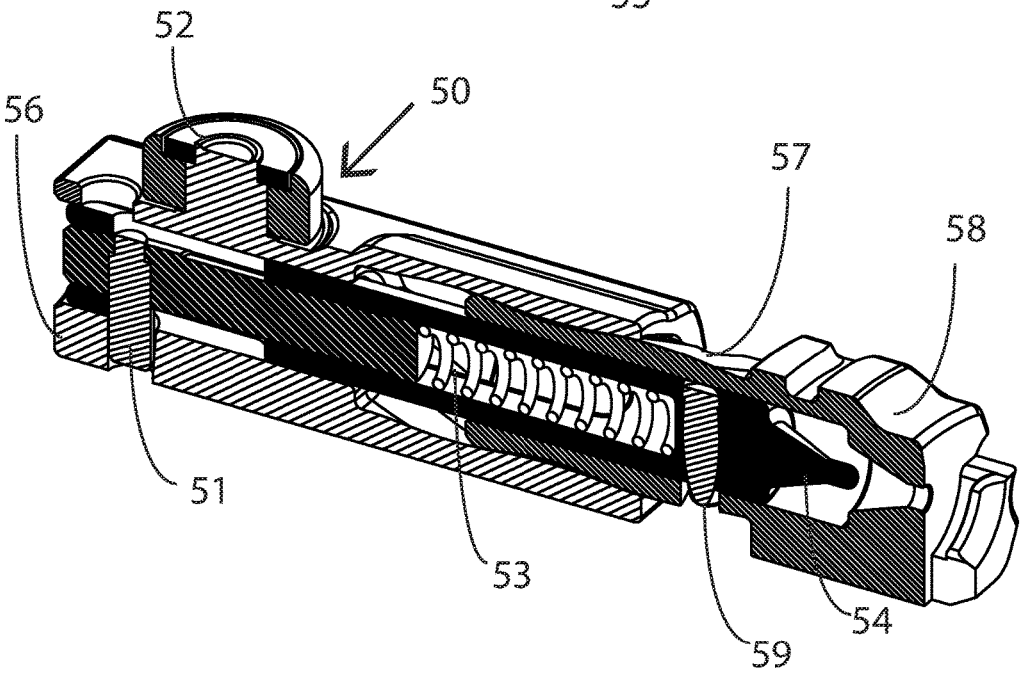
FIG. 16 is a sectional view of the firearm bolt of FIG. 6, taken along line C-C.
Figure 18:
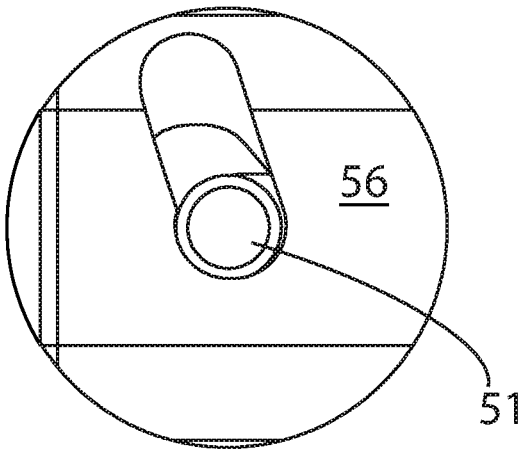
FIG. 18 is a close-up view of the firearm bolt of FIG. 7, taken in circle E.

The firing pin presents a small release pin 59 towards its forward end. This release pin interfaces with an L-shaped slot 60 along a side of the bolt head 58. The L-shaped slot 60 features two roughly orthogonal legs, one in a transverse direction in relation to the bolt axis 62 and one longitudinally along the bolt axis 64. A small aft hole in the bolt body 56 provides space for the reset pin 51 and presents a detent which captures the reset pin 51 as the bolt 50 is compressed (FIG. 18). Otherwise, the shape of the aft hole may be roughly triangular, as shown in FIG. 12, or may be a helical slot, as shown in FIG. 18, or any other suitable shape. A desirable shape for the aft hole would be on that presents the detent, as described, and also allows for some rotational movement of the firing pin 54 after firing, fitting with what is described in the firing process.

Figure 19:
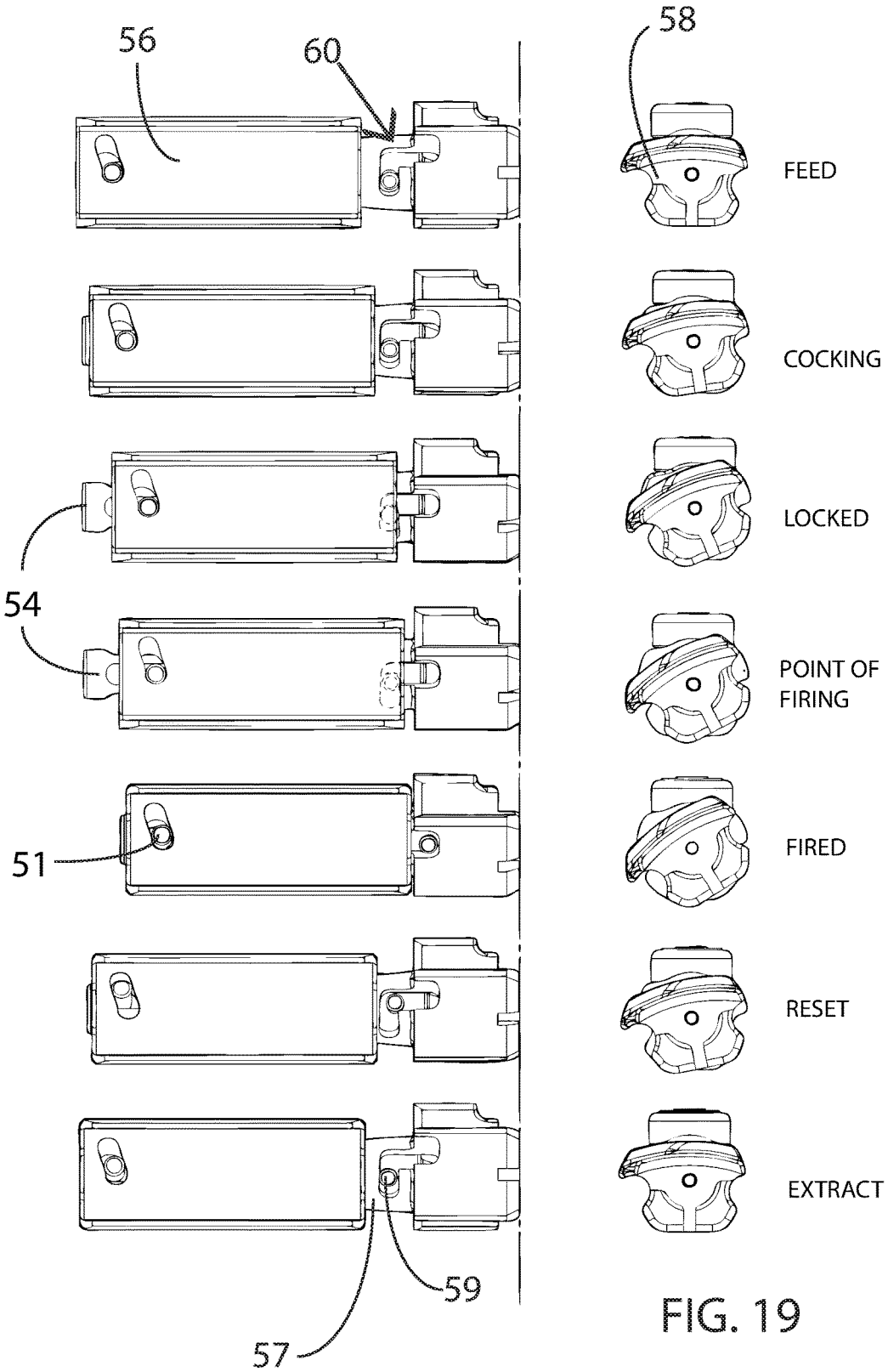
FIG. 19 is a multi-stage drawing, depicting the timing involved in a firing operation with an alternate firearm bolt.

The firing process is illustrated in FIG. 19. When in its starting position, the release pin is located in the transverse leg. There is no change in the relationship between the bolt head 58 and body 56 throughout most of the time the bolt 50 traverses the cam track 12. However, as the bolt 50 reaches the forwardmost position, the bolt head 58 stops as the ammunition is chambered in the barrel 12; but, the body 56 continues forward. This continuation drives the body 56 over the neck 57 and imparts a twist on the neck 57 and head 58 due to the helical keyed relationship between the pieces. The body 56 is also driven over the firing pin 54, compressing the spring and wedging the reset pin 51 into the detent of the aft hole, holding the firing pin rotationally static. Due to a slot in the firing pin 54, the firing pin will move over the resent pin 51 and extend outside of the bolt carrier body 56 as the spring 53 compresses. The twist of the keyed interface does force the head 58 to twist in relation to the firing pin 54 (COCKING). The L-shaped slot 60 then rotates in relation to the release pin 59, causing the release pin 59 to traverse the transverse leg until it is positioned in the corner of the L-shaped slot 60 (POINT OF FIRING) and is then freed (FIRING) to move longitudinally along the longitudinal leg. At this stage, the coil spring 53 is released and projects the firing pin 54 forwards so that the tip extends through a port in the bolt head 58 and impinges the ammunition blast cap, causing ignition. Releasing the firing pin 54 also releases the reset pin 51 from the detent, and allows slight rotation of the firing pin 54. The continuation of the bolt 50 along the cam track 12 then retracts the body 56 from the head, reversing the twist and causing the bolt to reset.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A bolt for a firearm comprising:

a. an elongate bolt carrier body having a bore longitudinally positioned along a bolt axis, the bore being helical with a polygonal circumference;

b. a firing pin, residing within the bore of the carrier body;

c. a bolt head;

d. a hollow bolt neck, extending rearward of the head, engaging the bore of the carrier body in a keyed relationship and through which the firing pin also resides;

wherein longitudinal interaction of the hollow bolt neck and the elongate bolt carrier body impart a twist on the bolt head.

2. The bolt of claim 1, the firing pin being spring biased.

3. The bolt of claim 2, further comprising a firing pin spring residing towards an aft portion of the bolt carrier body and the firing pin further comprising a reset pin interacting with the bolt carrier body.

4. The bolt of claim 3, the bolt head further comprising a slot with roughly two orthogonal legs and the firing pin further comprising a release pin residing within said slot, wherein twisting of the bolt head relative to the firing pin moves the release pin in relation to the slot.

5. The bolt of claim 1, the hollow bolt neck presenting loads which interface with the bore with inverses therebetween.

* * * * *